US005691597A

United States Patent [19]

Nishimura et al.

[11] Patent Number: 5,691,597

[45] Date of Patent: Nov. 25, 1997

[54] COLOR CATHODE-RAY TUBE AND METHOD FOR MANUFACTURING THE SAME

[75] Inventors: Takashi Nishimura, Fukaya; Toru Takahashi, Kumagaya, both of Japan

[73] Assignee: Kabushiki Kaisha Toshiba, Kawasaki, Japan

[21] Appl. No.: 592,532

[22] Filed: Jan. 26, 1996

[30] Foreign Application Priority Data

Jan. 27, 1995 [JP] Japan ..... 7-011231

[51] Int. Cl.[6] ..... H01J 29/86; H01J 31/20

[52] U.S. Cl. ..... 313/402; 313/408; 313/407; 313/477 R; 313/482

[58] Field of Search ..... 313/422, 495, 313/402, 407, 408, 477 R, 2.1, 496, 482; 220/2.1 A, 2.3 A

[56] References Cited

U.S. PATENT DOCUMENTS

| | | | |
|---|---|---|---|
| 4,259,612 | 3/1981 | Christiano et al. | 313/422 |
| 4,714,856 | 12/1987 | Takenaka et al. | 313/2.1 |
| 4,994,704 | 2/1991 | Takenaka et al. | 313/2.1 |
| 5,032,756 | 7/1991 | Takenaka et al. | 313/2.1 |
| 5,287,034 | 2/1994 | Kamohara et al. | 313/422 |
| 5,365,142 | 11/1994 | Nishimura et al. | 313/2.1 |
| 5,365,143 | 11/1994 | Nishimura et al. | 313/402 |
| 5,506,467 | 4/1996 | Nishimura et al. | 313/407 X |

FOREIGN PATENT DOCUMENTS

| | | |
|---|---|---|
| 0 471 359 | 2/1992 | European Pat. Off. . |
| 0 520 795 | 12/1992 | European Pat. Off. . |
| 0 634 774 | 1/1995 | European Pat. Off. . |
| 5-36363 | 12/1993 | Japan . |

*Primary Examiner*—Ashok Patel

*Attorney, Agent, or Firm*—Cushman Darby & Cushman IP Group of Pillsbury Madison & Sutro LLP

[57] ABSTRACT

A shadow mask is arranged in an envelope and opposes a phosphor screen formed on an inner surface of a face plate. The shadow mask includes a plurality of mask pieces arranged in series. Each of the mask pieces has effective portions in which a number of electron beam passage apertures are formed. A plurality of mask frames supporting the respective mask pieces are fixed to the inner surface of the face plate. A plurality of stages are provided on the inner surface of the face plate. Each of the stages has a first end in contact with the inner surface of the face plate and a second end in contact with one of the mask piece, so as to define a distance between each of the mask pieces and the phosphor screen and to apply a tensile force to the mask piece.

15 Claims, 9 Drawing Sheets

COLOR CATHODE-RAY TUBE AND METHOD FOR MANUFACTURING THE SAME

BACKGROUND OF THE INVENTION

1. Field of the Invention

The present invention relates to a cathode-ray tube and, more particularly, to a color cathode-ray tube wherein a phosphor screen has a plurality of regions which are scanned independently of one another, and also to a method for manufacturing the cathode-ray tube.

2. Description of the Related Art

In recent years, as disclosed in, for example, Jpn. Pat. Appln. KOKAI Publication No. 5-36363, a type of color cathode-ray tube has been developed, in which a plurality of independent cathode-ray tubes are continuously arranged and the phosphor screens of these tubes are integrated. The cathode-ray tube including the integrated phosphor screen has a vacuum envelope constituted by a face plate on which the phosphor screen is formed, a rear plate opposing the face plate, and a plurality of funnels attached to the rear plate. In the envelope, a shadow mask is arranged opposite to the phosphor screen.

The face plate is flat, and the integrated phosphor screen formed on the inner surface of the face plate is divided into a plurality of regions which are individually scanned by electron beams emitted from a plurality of electron guns.

In the aforementioned color cathode-ray tube, since the face plate is flat, the shadow mask, arranged opposite to the phosphor screen, must also be formed to be flat. For this reason, the following problems are posed.

First, there is a problem in the method of attaching the shadow mask. Specifically, in the case of a conventional color cathode-ray tube having a spherical face plate, the shadow mask is also spherical. In this case, by fixing a strong frame to a peripheral portion of the shadow mask, practical mechanical strength can easily be given to the shadow mask. It is therefore easy to situate the shadow mask in a predetermined positional relationship with the phosphor screen formed on the inner surface of the face plate.

However, in the case of a flat face plate, since the shadow mask must also be flattened, satisfactory mechanical strength of the shadow mask cannot be obtained. Accordingly, this shadow mask cannot easily be situated in a predetermined positional relationship with the phosphor screen only by fixing a frame to the peripheral portion of the shadow mask to reinforce the mask, as in the prior art.

In general, by fixing a flat shadow mask to a robust frame with a tensile force applied to the shadow mask, the shadow mask is given sufficient mechanical strength and can be situated in a predetermined positional relationship with the face plate via the frame. In this structure, however, with an increase in screen size, the tensile force required for the shadow mask is increased accordingly. Consequently, a more robust frame is required. In this case, the weight of the entire color cathode-ray tube increases. Moreover, the attaching means for attaching the shadow mask to a face plate via the frame must have a complicated structure. Furthermore, a sufficient space for providing the attaching means is required.

Secondly, there is a problem in mounting precision of the shadow mask. A phosphor screen of a regular color cathode-ray tube is formed by exposing a phosphor screen material layer, such as a phosphor slurry coated on the inner surface of a face plate, by a photographic printing method using a shadow mask, which is to be incorporated in the color cathode-ray tube, as a mask for exposing. If, therefore, the distance (q-value) between the shadow mask and the inner surface of the face plate is deviated from a predetermined value, the arrangement pitch of phosphor layers which constitute the phosphor screen is affected, but the continuity of the entire phosphor screen is not affected.

In the case of a color cathode-ray tube wherein an integrated phosphor screen has a plurality of regions which are scanned independently of one another, the shadow mask has a plurality of effective portions corresponding to the regions of the phosphor screen. Each effective portion has a number of electron beam passage apertures. The effective portions are connected with each other via non-effective portions having no electron beam passage apertures. For this reason, in a color picture tube of this type, the phosphor screen is influenced by the q-value between adjacent regions of the phosphor screen. More specifically, when the q-value is greater than the predetermined value, phosphor layers on adjacent regions of the phosphor screen overlap one another; when the q-value is smaller than the predetermined value, a gap is produced between the adjacent regions of the phosphor screen.

In addition, when a phosphor screen is formed by a master mask method using a photomask or the like, the q-value must be set accurately. According to the master mask method, a phosphor screen having continuity can be accurately formed. If, however, the q-value is not exact, an electron beam does not land on a predetermined phosphor layer, i.e., so-called miss-landing occurs, when a color cathode-ray tube is assembled. Further, images between adjacent regions overlap one another, or a gap is produced between the images.

Furthermore, regardless of the formation of the phosphor screen, the required precision of the q-value is about 0.01 mm, though it depends on the horizontal deflection angle of the electron beam or the arrangement pitch of the electron beam passage apertures of the shadow mask. In comparison with the fact that the conventional color cathode-ray tube requires manufacturing precision of about 0.5 mm, the q-value must be set with much higher precision. For this reason, in a color cathode-ray tube wherein one integrated phosphor screen formed on the inner surface of a flat face plate has a plurality of regions which are scanned independently of one another, it is substantially impossible to mount a shadow mask by the conventionally known means.

Thirdly, there is a problem in deformation and vibration in a shadow mask. A flat shadow mask is susceptible to deformation and vibration. When the shadow mask is deformed, the q-value varies, thus causing miss-landing. In addition, when the shadow mask is vibrated, miss-landing also occurs because the q-value changes during the vibration.

Fourthly, there is a problem in deformation which arises when the shadow mask is attached to the mask frame. As described above, the flat shadow mask is fixed to the mask frame by welding with a tensile force applied to the shadow mask in order to increase the mechanical strength. At this time, the portion of the shadow mask near the welded portion is liable to deform. The deformation is caused as follows. Since the portion near the welded portion is temporarily welded with a tensile force applied to the shadow mask, the stress (tensile force) is partially weakened. After the welded portion is cooled, difference in stress arises between the welded portion and adjacent portions. The difference causes the deformation.

The deformation can be considerably reduced by optimizing the welding conditions and selecting the most suitable welding portion. It is, however, difficult to completely eliminate the influence of the deformation. Particularly in a color cathode-ray tube, which requires accurate flatness of the shadow mask and q-value, the deformation may be a critical defect.

Fifthly, there is a problem in the positional relationship between the shadow mask and the phosphor screen. As described before in connection with the second problem, the distance (q-value) between the shadow mask and the phosphor screen must be set very precisely. In addition, it is important to position the shadow mask surface and the phosphor screen surface accurately. More specifically, the shadow mask should be set precisely in a position relative to the phosphor screen in respect of the horizontal and vertical axes and the rotational direction. The set precision must be about 0.01 mm, though it depends on the arrangement pitch of the electron beam passage apertures of the shadow mask and the phosphor layers of the phosphor screen.

It is preferable that the positional relationship between the shadow mask and the phosphor screen be adjusted, while they are simultaneously and directly observed. Practically, however, it is difficult to observe, for example, the phosphor screen through the shadow mask. Further, since an aluminum deposition film is formed on the back surface of the phosphor screen, it is impossible to accurately see the position of the phosphor layer. It is therefore difficult to observe the shadow mask and the phosphor screen simultaneously and directly.

For this reason, according to the conventional method, the shadow mask and the phosphor screen are positioned relative to each other as follows. First, the phosphor layers are observed from the outside of the face plate. The phosphor layers are positioned to a fixing jig and the face plate is fixed to the jig. In the same manner, the electron beam passage apertures of the shadow mask are positioned on a fixing jig and the shadow mask is fixed to the jig. In this method, however, since positioning errors accumulate, positioning with a high degree of accuracy cannot be achieved.

As described above, in a color cathode-ray tube wherein one integrated phosphor screen formed in the inner surface of a flat face plate has a plurality of regions which are scanned independently of one another, since the shadow mask arranged opposite to the phosphor screen must also be flat, problems are posed in terms of a method of attaching the shadow mask, mounting precision of the shadow mask, deformation or vibration of the shadow mask, deformation of the shadow mask which arises when the shadow mask is attached to the mask frame, setting of the positional relationship between the shadow mask and the phosphor screen, and so on. Especially in a large-sized color cathode-ray tube, it is very difficult to mount a shadow mask with high precision. In addition, it is difficult to realize a simple, lightweight means for mounting the shadow mask. Furthermore, a flat shadow mask is extremely susceptible to deformation and vibration.

SUMMARY OF THE INVENTION

The present invention has been made to solve the above problems, and has its object to provide a color cathode-ray tube, in which a flat shadow mask is arranged at a predetermined position with respect to a phosphor screen with high precision, and which is highly resistant to deformation and vibration.

To achieve the above object, according to a first aspect of the present invention, a color cathode-ray tube comprises: an envelope including a substantially rectangular face plate having first and second axes perpendicular to each other; a phosphor screen formed on an inner surface of the face plate; a shadow mask arranged in the envelope and opposing the phosphor screen; and a plurality of electron guns for scanning a plurality of regions of the phosphor screen independent of one another by emitting electron beams to the phosphor screen through the shadow mask.

The shadow mask includes a plurality of mask pieces arranged in series along the first axis, each of the mask pieces having effective portions in which a number of electron beam passage apertures are formed. Both end portions of the mask piece as viewed in the direction of the second axis are fixed to a mask frame. Stages are fixed to the inner surface of the face plate. Each stage has a first end in contact with the face plate and a second end in contact with the mask piece or the mask frame, so as to define a distance between the mask piece and the phosphor screen to a predetermined value.

In the color cathode-ray tube having above mentioned construction, the shadow mask is constituted by a plurality of mask pieces, arranged in series along the first axis, each mask piece having effective portions including a number of electron beam passage apertures. For this reason, the length of the shadow mask along the first axis can be reduced in accordance with the number of the mask pieces, thereby reducing the tensile force applied to the shadow mask. Therefore, the mask frame can be made simple and light.

Further, the distance (q-value) between the shadow mask and the phosphor screen formed on the inner surface of the face plate can be set accurately by providing a pair of stages each having a first end in contact with the inner surface of the face plate and a second end in contact with the mask frame or the mask piece. Since the height of the stages can be set with high precision by mechanical processing, it is possible to prevent variance of the distance (q-value) between the shadow mask and the inner surface of the face plate, due to the accuracy of fixing the mask piece to the mask frame. Further, the effective portion of the mask piece is prevented from an influence of deformation which arises when the mask piece is welded to the mask frame.

In addition, the tensile force applied to the mask piece can be adjusted by the stages. Therefore, the mask piece is attached to the mask frame with a small tensile force, so that the mask frame can be welded to the mask frame with a small force. As a result, deformation in welding the mask piece to the mask frame is reduced. It is possible to apply a desired tensile force to the mask piece, when the mask piece is brought into contact with the stage.

According to a second aspect of the present invention, a color cathode-ray tube has a plurality of positioning marks on the inner surface of the face plate on both end portions thereof along the second axis of the phosphor screen, at predetermined positions with respect to the phosphor screen. Positioning holes corresponding to the positioning marks are formed on both end portions of each mask piece along the second axis. Each mask piece is arranged such that the positioning holes are aligned with the positioning marks.

With the above color cathode-ray tube, the shadow mask is constituted by a plurality of mask pieces, each having effective portions including a number of electron beam passage apertures. Both end portions of each mask piece along the second axis are fixed to one of a plurality of mask frames. For this reason, as in the color cathode-ray tube according to the first aspect of the present invention, the length of the shadow mask in the horizontal direction can be reduced in accordance with the number of the mask pieces, thereby reducing the tensile force applied to the shadow mask. Therefore, the mask frame can be simple and light.

Further, the positioning holes are formed outside the effective portions of each mask piece in both end portions along the second axis and the positioning marks are formed in both end portions in the vertical direction of the phosphor screen in accordance with the positioning holes. With this feature, the mask piece and the phosphor screen, separated from each other at a distance, can be positioned with high precision by positioning the positioning holes with the positioning marks.

According to the present invention, there is provided a method of manufacturing a color cathode-ray tube which comprises: a substantially rectangular face plate having first and second axes perpendicular to each other; a phosphor screen formed on an inner surface of the face plate; a shadow mask opposing the phosphor screen, the shadow mask including a plurality of mask pieces arranged in series along the first axis, each mask piece extending along the second axis and having an effective portion in which a number of electron beam passage apertures are formed; and beam emitting means for emitting electron beams to the phosphor screen through the effective portions of the mask pieces so as to dividedly scan a plurality of regions of the phosphor screen, the method comprising the steps of: forming, on the inner surface of the face plate in one process, the phosphor screen and a plurality of positioning marks on both end sides of the phosphor screen in a direction of the second axis and arranged at predetermined positions with respect to the phosphor screen; forming, on each mask piece in one process, the electron beam passage apertures and positioning holes in predetermined portions on both end portions in the direction of the second axis of the mask piece; positioning each mask piece such that the positioning holes are aligned with the corresponding positioning marks; and attaching the positioned mask piece to the face plate.

In the above mentioned method, the effective portions and the positioning holes of each mask piece are formed in the same process, and the phosphor screen and the positioning marks of the screen portions are formed in the same process. The positioning holes and the positioning marks are positioned along the same axis, thereby positioning the phosphor screen and the mask piece. For this reason, the positioning holes and the positioning marks have accurately the same positional relationship with respect to the effective portions of the mask piece and the phosphor screen, respectively. Therefore, the phosphor screen and the mask piece can be positioned with each other with high precision by positioning the positioning holes with the positioning marks.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 7 show a color cathode-ray tube according to a first embodiment of the present invention, in which FIG. 1 is a perspective view of the structure of the color cathode-ray tube, FIG. 2 is a sectional view taken along a line II—II in FIG. 1, FIG. 3 is an exploded perspective view of the color cathode-ray tube, FIG. 4 is an enlarged sectional view of a face plate and a support member, FIG. 5 is a perspective view of a mask frame, FIG. 6 is an enlarged sectional view of the mask frame and a mask piece fixing portion, and FIG. 7 is a perspective view of a stage;

FIGS. 13A to 16B are diagrams showing main part of a color cathode-ray tube according to a second embodiment of the present invention, in which FIG. 13A is a plan view of a phosphor screen and a non-luminous portion of the face panel, FIG. 14 is an enlarged plan view of part of a mask piece, FIG. 15 is a perspective view of the mask frame, FIG. 16B is a plan view schematically showing a positioning mark and a positioning hole;

FIGS. 17A to 19B are diagrams showing main part of a color cathode-ray tube according to a third embodiment of the present invention, in which FIG. 17A is a plan view of a phosphor screen and a non-luminous portion of the face panel, FIG. 19B is a plan view schematically showing a positioning mark and a positioning hole.

DETAILED DESCRIPTION OF THE PREFERRED EMBODIMENTS

Embodiments of the present invention will be described in detail with reference to the accompanying drawings.

Figure 1:
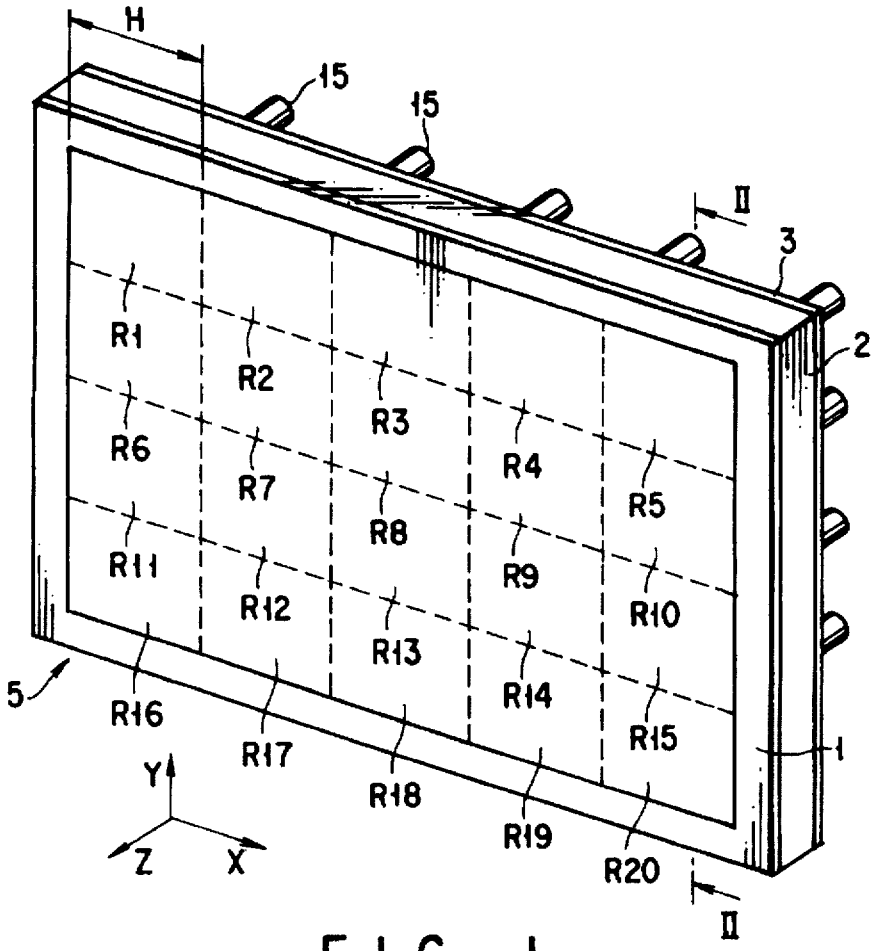
Figure 2:
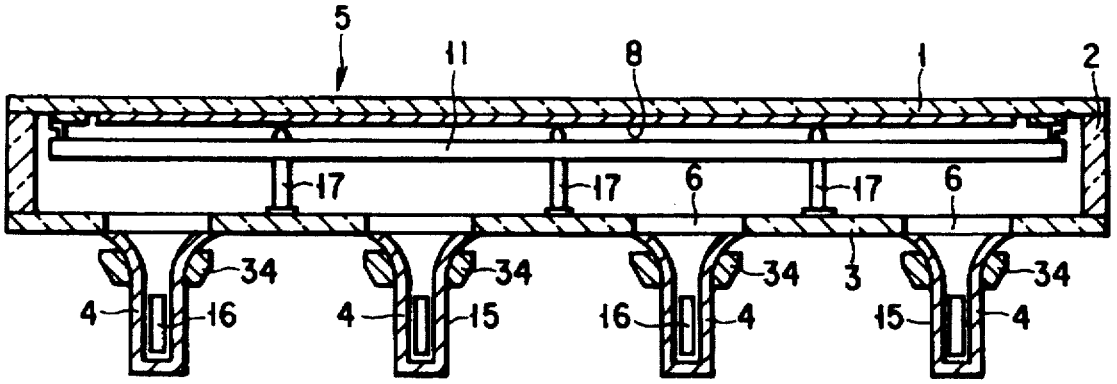
Figure 3:
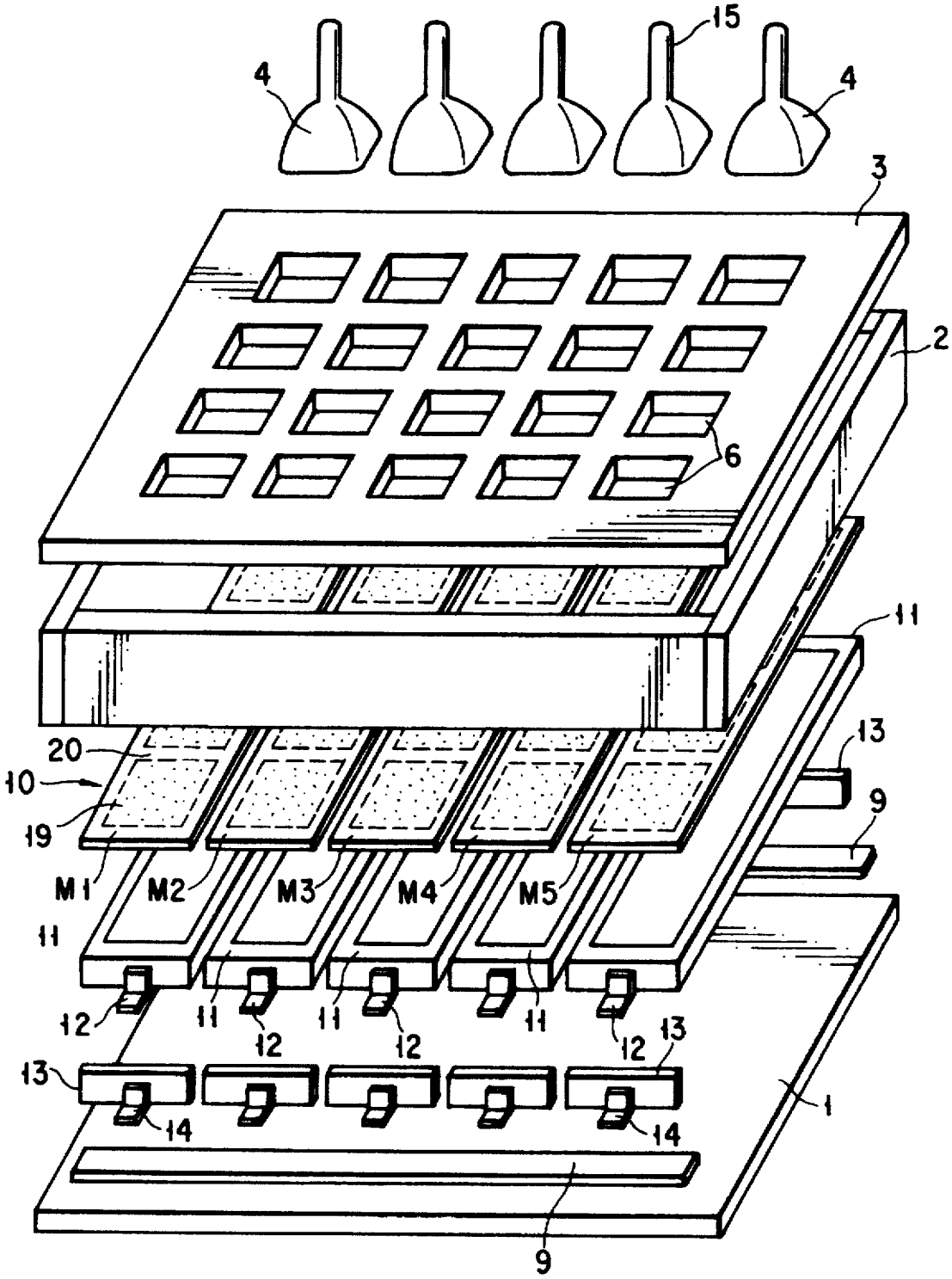

FIGS. 1 to 3 show a color cathode-ray tube according to a first embodiment of the present invention. This color cathode-ray tube is constructed such that a single phosphor screen has a plurality of regions, which are dividedly scanned by electron beams emitted from a plurality of electron guns, and divisional images obtained from the regions are integrated, thereby displaying a synthesized image on the phosphor screen.

The color cathode-ray tube has a vacuum envelope 5, which includes: a substantially rectangular, flat face plate 1, formed of glass and having a horizontal axis (X axis) and a vertical axis (Y axis); a frame-like side wall 2 formed of glass, joined to the peripheral portion of the face plate 1 and extending in a direction substantially perpendicular to the face plate 1; a substantially rectangular, flat rear plate 3, formed of glass, joined to the side wall 2 and opposite and parallel to the face plate 1; and a plurality of funnels 4 joined to the rear plate 3. The rear plate 3 has a plurality of (e.g., 20) rectangular openings 6, which are arranged in a matrix, e.g., five (columns)× four (rows). The funnels 4 are joined to the outer surface of the rear plate 3 to surround the corresponding openings 6. A total of 20 funnels are arranged in a matrix of five funnels in the horizontal direction (X direction)× four funnels in the vertical direction (Y direction).

Figure 4:
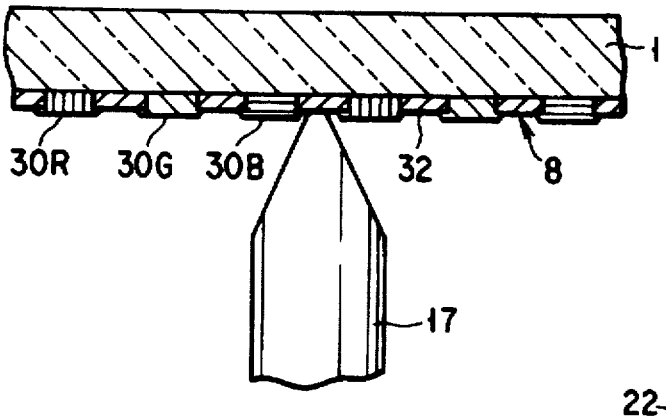

As shown in FIG. 4, an integrated phosphor screen 8 is formed on the inner surface of the face plate 1. The phosphor screen 8 has stripe-shaped three-color phosphor layers 30B, 30G, 30R, extending in the vertical direction, which respectively emit blue, green and red light, and black stripes 32 provided between the three-color phosphor layers and extending in the vertical direction. The stripes are arranged regularly side by side in the horizontal direction. The phosphor screen 8 as a whole has a rectangular shape, which is slightly smaller than the face plate.

As shown in FIGS. 2 and 3, a pair of elongated plate-shaped fixing members 9 are fixed to the inner surface of the face plate 1 by, for example, frit glass. The fixing members 9 are located at both end portions in the vertical direction of the phosphor screen 8, with the phosphor screen 8 interposed therebetween. The fixing members 9, extending in the X direction, are formed of a nickel alloy having a coefficient of thermal expansion, approximate to that of the face plate 1 made of glass.

A shadow mask 10 is arranged in the envelope 5 to oppose the phosphor screen 8. The shadow mask 10 has a plurality of (five, in this embodiment) rectangular flat mask pieces M1 to M5. The longitudinal direction of the mask pieces corresponds to the vertical direction.

The mask pieces M1 to M5 are supported by rectangular mask frames 11, respectively, and arranged in parallel at predetermined intervals in the horizontal direction. The longitudinal direction of the mask frames 11 corresponds to the vertical direction. Each of the mask frames 11 is held on the face plate 1 by fixing pieces 12, attached to both ends of the mask frame, to the fixing members 9 fixed to the inner surface of the face plate 1. A pair of stages 13 are arranged between each of the mask pieces M1 to M5 and the inner surface of the face plate 1, in order to set the distance (q-value) therebetween to a predetermined value. An end of each stage 13 is fixed to the fixing member 9 with a fixing piece 14 and the other end thereof is brought into contact with the corresponding mask piece through the inside of the vertical end portion of the corresponding mask frame 11. The shadow mask 10, the mask frame 11 and the stage 13 will be described in detail later.

The funnels 4 have, within their necks 15, electron guns 16 which emit electron beams toward the phosphor screen 8. A plurality of columnar plate support members 17, made of metal, are arranged between the face plate 1 and the rear plate 3 to support the atmospheric load acting on the face plate I and the rear plate 3. As shown in FIG. 4, the distal end of each plate support member 17 is wedge-shaped and brought into contact with the black stripe 32 of the phosphor screen 8. The proximal end of the plate support member 17 is fixed to the rear plate 3 with, for example, frit glass.

In the above-mentioned color cathode-ray tube, electron beams emitted from the electron guns 16 arranged in the necks 15 are deflected in the horizontal and vertical directions by magnetic fields generated by a plurality of deflecting devices 34 mounted on the exterior of the funnels 4. The deflected beams individually scan a plurality of divided regions R1 to R20 (five regions in the horizontal direction; four regions in the vertical direction) of the phosphor screen 8 through the shadow mask 10. In the divisional scanning, divisional images formed on the phosphor screen 8 are joined with one another by means of a signal applied to the electron guns and the deflecting devices 34, thereby forming a large synthesized image, with no overlap or gap, on the phosphor screen 8.

The shadow mask is divided into the mask pieces M1 to M5 of the number corresponding to the number of the divided regions (R1 to R20) arranged in the horizontal direction. In each of the mask pieces M1 to M5, a plurality of effective portions 19, having a number of electron beam passage apertures, are arranged in the longitudinal direction of the mask piece, such that a non-effective portion 20 is interposed between the adjacent effective portions 19. Four effective portions 19 are formed in one mask piece in accordance with the number of the divided regions, arranged in the vertical direction, of the phosphor screen. Each of the mask pieces M1 to M5 has non-effective portions 20 in both end portions in the vertical direction and both edge portions in the horizontal direction. Thus, every effective portion 19 is surrounded by the non-effective portions 20.

Figure 5:
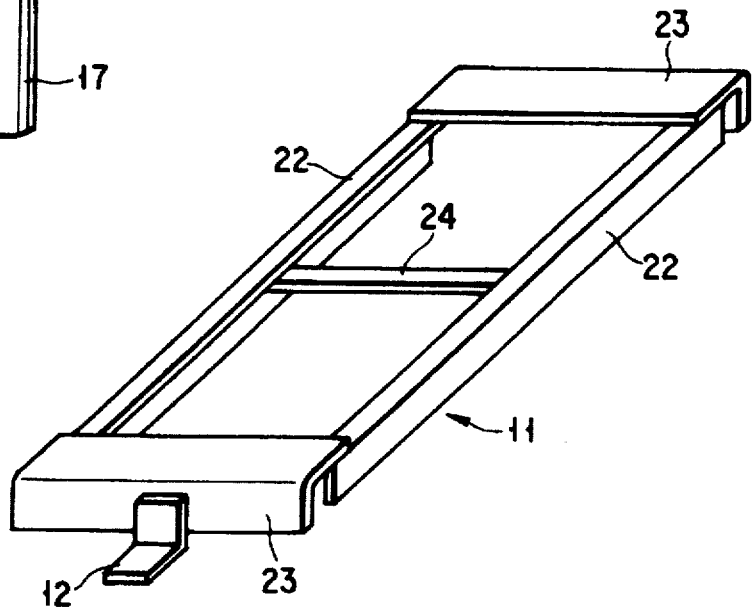

As shown in FIG. 5, the mask frame 11 for holding each of the mask pieces M1 to M5 is shaped as a rectangle with a pair of side frames 22, each having an L-shaped cross section, arranged parallel to each other, a pair of end frames 23, each having an L-shaped cross section, arranged to cover both the ends of the side frames 22, and a reinforcing beam 24 extending across the side frames 22 in their middle portion. The fixing pieces 12 are attached to the sides of the end frames 23, respectively.

Each of the mask pieces M1 to M5 is fixed to the mask frame with a tensile force applied in the longitudinal direction, by welding both ends of the mask piece to the upper surfaces of the end frames 23 located at both ends of the mask frame 11 in the longitudinal direction, by means of laser spot welding at 1 mm pitches. Thus, there is a gap, corresponding to the thickness of the end frame 23, between the mask piece and the side frames 22. This structure is advantageous in preventing deformation of the mask piece due to the contact with the side frame 22, when each of the mask pieces M1 to M5 is attached to the mask frame 11.

Figure 6:
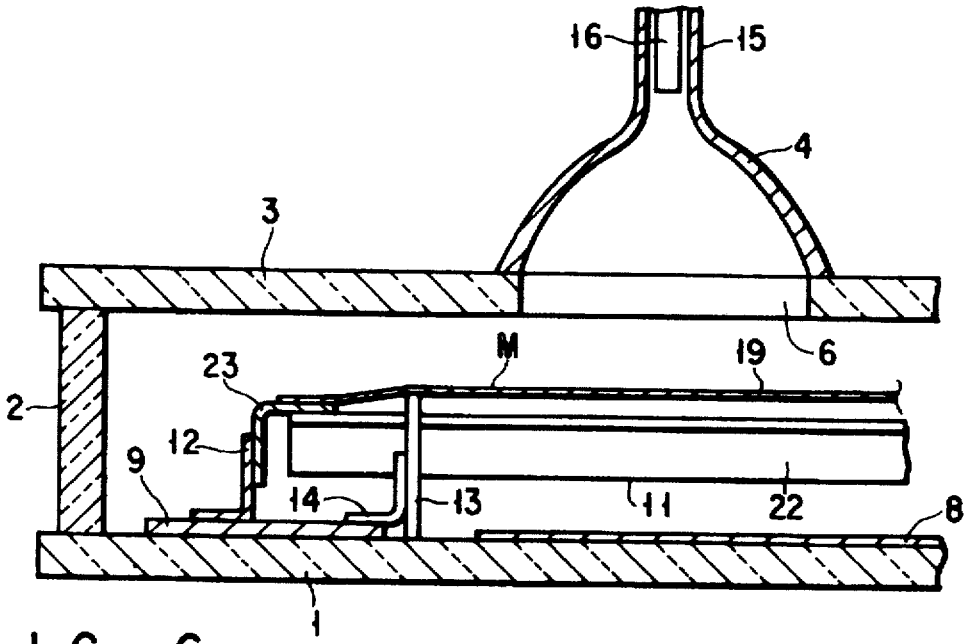

As shown in FIG. 6, the mask frame 11, to which the mask piece is attached, is supported on the face plate 1 by fixing the pair of fixing pieces 12 to the pair of fixing members 9. The effective portions 19 of each mask piece face the corresponding openings 6 of the rear plate 3.

Figure 7:
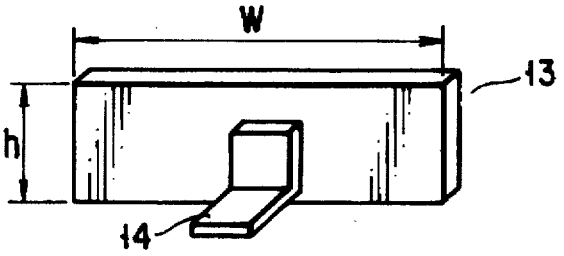

As shown in FIGS. 6 and 7, each stage 13 is formed of a rectangular plate of a nickel alloy or stainless steel. The width w of the stage 13 is substantially the same as the inner gap between the side frames 22 of the mask frame 11. The stage 13 is worked such that its height h is set to a predetermined value with high precision, in order to arrange the mask piece at a position which is spaced from the face plate 1 by the predetermined distance (q-value). The stage 13 has an L-shaped fixing piece 14 fixed to one surface thereof.

The stage 13 is mounted on the face plate 1 by attaching the fixing piece 14 to the fixing member 9. The stage 13 is arranged near the end frame 23 between the side frames 22 of the mask frame 11, and stands perpendicular to the face plate 1. The stage 13 extends from the face plate over the side frames 22. One end of the stage 13 is brought into contact with the inner surface of the face plate 1, and the other end, with the mask piece.

With the pair of stages 13 provided for each mask piece, the end portions of the mask piece is slightly pressed up toward the rear frame 3, so that the tension of the mask piece can be increased to a required value and the mask piece can be positioned with respect to the inner surface of the face plate 1 at a predetermined distance therebetween.

More specifically, each of the mask pieces M1 to M5 of the color cathode-ray tube is made of an elongated low carbon-steel plate having a thickness of 0.15 mm, a length in the vertical direction of about 340 mm, and a width in the horizontal direction of about 80 mm. The low carbon-steel plate includes four effective portions 19, each having a length in the vertical direction of about 60 mm and a width in the horizontal direction of about 64 mm. The effective portions 19 are arranged in the vertical direction with the non-effective portions 20 interposed between the two adjacent effective portions. Each effective portion 19 has slit-like electron beam passage apertures of a width of about 0.2 mm. Each stage 13, made of a nickel alloy, stainless steel or the like, has a thickness of 0.8 mm and a height (hi of about 8 mm, which is substantially equal to the distance (8 mm) between the inner surface of the face plate 1 and the mask piece.

The aforementioned color cathode-ray tube is assembled as follows.

First, the fixing members 9 are fixed with frit glass to the inner surface of the face plate at both end portions in the vertical direction. Then, a phosphor screen 8 is formed on the inner surface of the face plate 1, on which the fixing members 9 are fixed, by means of the master mask method in the photographic printing. The phosphor screen 8 is formed in the same manner as forming a conventional black-stripe type color cathode-ray tube; that is, first, black stripes are formed by using photosensitive material, black coating, or the like, and then stripe-shaped three-color phosphor layers are formed between the black stripes by using photosensitive phosphor slurry. Thereafter, aluminum film is deposited on the back surface of the black stripes and the three-color phosphor layers. Thus, the phosphor screen 8 is obtained.

Independent of the formation of the phosphor screen 8, the mask pieces M1 to M5 are formed by the photoetching method in the same manner as forming a shadow mask of a conventional color cathode-ray tube. The mask pieces M1 to M5 are arranged by using a mounting jig and fixed to the end frames 23 of the mask frames 11 with a tensile force, which is smaller than the final tensile force, by means of laser spot welding at 1 mm pitches. The electron guns 16 are sealed within the necks 15 of the funnels 4.

Subsequently, the stages 13 are positioned and fixed, by using a mounting jig, to the fixing members 9 attached to the inner surface of the face plate 1. The mask pieces M1 to M5, attached to the mask frames 11, are arranged so as to be in contact with the pair of stages 13 and positioned in a predetermined positional relationship with respect to the phosphor screen 8 formed on the inner surface of the face plate 1. Then, the mask frames 11 are pressed toward the face plate 1, until the fixing pieces 12 are brought into contact with the fixing members 9, and the fixing pieces 12 are welded to the fixing members 9.

Thereafter, the face plate 1 to which the mask pieces M1 to M5 are attached, the side wall 2, the rear plate 3, and the funnels 4 in which the electron guns 16 are sealed, are joined together at a predetermined positional relationship and integrally connected with frit glass. The subsequent processes, such as exhaustion, are performed in the same manner as in the formation of the conventional color cathode-ray tube, thereby producing a color cathode-ray tube of the present invention.

The color cathode-ray tube can be manufactured by methods other than that as described above. For example, the funnels 4 in which the electron guns 16 are sealed may be connected to the rear plate 3 in advance. Then the face plate 1, to which the mask pieces M1 to M5 are attached, and the rear plate 3, to which the side wall 2 and the funnels 4 are attached, are integrally connected to each other.

With the color cathode-ray tube constructed as described above, the following effects and advantages can be obtained.

(a) Since the stages 13 made of plate members are arranged between the face plate 1 and the mask pieces M1 to M5, the distance between the face plate 1 and the shadow mask 10 can be set very precisely. For example, assume that the stripe three color phosphor layers formed on the inner surface of the face plate 1 are arranged at the horizontal pitches of 0.6 mm and the width of the black stripes is 0.1 mm. In this case, to continuously arrange the regions R1 to R20 individually scanned by the electron beams emitted from the electron guns 16, it is necessary that the width of an overlapped portion or a gap between adjacent regions be ⅕ or smaller than the width of the black stripe. Further, when the dimension H in the horizontal direction of each of the regions R1 to R20 is 80 mm, the distance between the inner surface of the face plate 1 and the shadow mask 10 (q-value) is 8 mm.

An amount of deviation Δq from the predetermined q-value is obtained by the following equation:

$$\Delta q = D \cdot (L-q)/(H/2) + D$$

where D is the width of the overlapped portion between adjacent two of the regions R1 to R20, L is the distance between the center of deflection of the electron beam and the phosphor screen 8, and H is the dimension in the horizontal direction of each of the regions R1 to R20.

According to the above equation, the precision of the q-value required in the color cathode-ray tube of this embodiment is 0.02 mm. In this case, the stage 13 for setting the q-value can be manufactured by the conventional processing method at low cost.

(b) Since the stages 13 are arranged between the inner surface of the face plate 1 and the shadow mask 10 to set the distance therebetween, the manufacturing precision of the mask frames 11 for holding the mask pieces M1 to M5 need not be very high. In addition, since the shadow mask 10 is divided into a plurality of mask pieces, if the shadow mask is constituted by five mask pieces M1 to M5 as in this embodiment, the tensile force applied to each mask piece is about ⅕ the force which is applied in a case of using a single continuous shadow mask. Accordingly, the structure of the mask frames 11 for supporting the tensile force can be simplified. More specifically, a mask frame formed simply by bending a steel plate of a thickness of about 0.1 mm can provide satisfactory strength. Thus, the mask frame can be lighter and cost less as compared to the mask frame of the conventional color cathode-ray tube.

(c) The stages 13 are arranged between the inner surface of the face plate 1 and the shadow mask 10, such that first ends of the stages are brought into contact with the mask pieces M1 to M5, and a predetermined tensile force is applied to the mask pieces. In this state, deformation of the mask pieces (e.g., a wrinkle), produced by welding the mask pieces to the mask frames, does not extend to the effective portions 19.

(d) Since the tensile force applied to the mask pieces M1 to M5 can be increased by the stages 13, the tensile force of the mask pieces, applied when the mask pieces are welded to the mask frames 11, can be set low. Further, the tensile force finally applied to the mask pieces M1 to M5 can be increased by the stages 13, thereby adjusting the tensile forces applied to the mask pieces.

(e) Since the shadow mask 10 is constituted by a plurality of mask pieces spaced apart in the horizontal direction, purity drift due to thermal expansion of the shadow mask can be prevented. In other words, even if any one of the mask pieces is heated by collision of electron beams, the heat thereof will not be transferred to the mask pieces arranged adjacent to the heated mask piece in the horizontal direction. On the other hand, the heat is transferred in the vertical direction, causing thermal expansion. However, since the phosphor screen is formed of elongated stripe three color phosphor layers, extending in the vertical direction, positional deviation due to the thermal expansion does not matter. It is therefore possible to prevent purity drift due to thermal expansion of the mask pieces.

Figure 8:
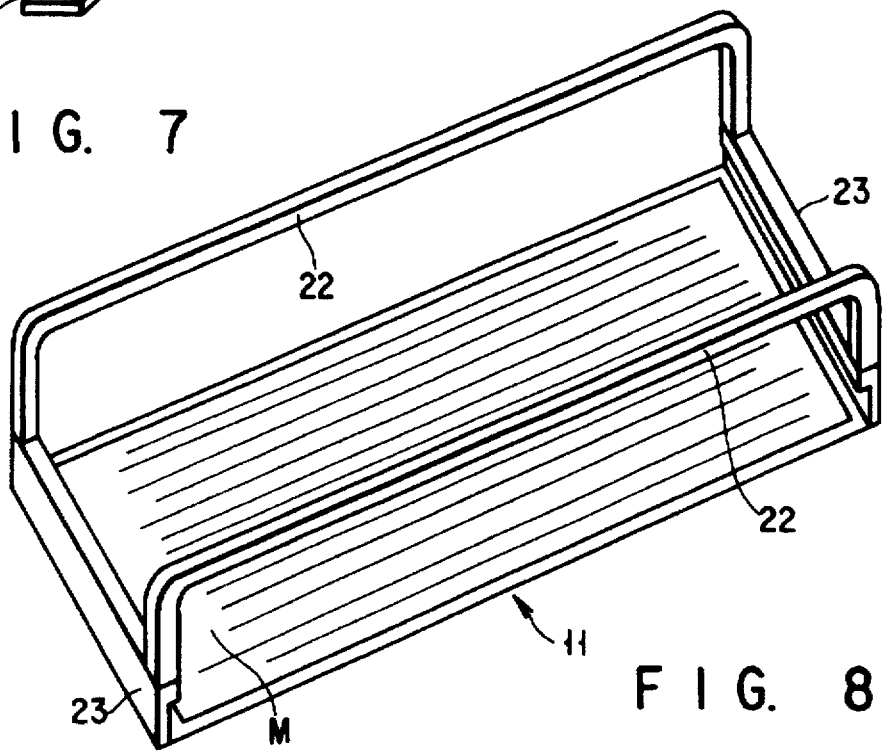
FIG. 8 is a perspective view of a modification of the mask frame.

In the above embodiment, the mask frame 11 is formed of bars having an L-shaped cross section. The present invention, however, is not limited to this structure, but can be modified as shown in FIG. 8, in which the mask frame is formed of strong elongated metal members having a rectangular cross section.

In this modification, the mask frame 11 has a pair of parallel side frames 22, and the ends of the side frames are bent substantially at right angles in the same direction. The ends of the side frames 22 are connected to each other by end frames 23 formed of plate members having a rectangular cross section. The ends of a mask piece are fixed to the edges of the end frames 23.

Upon attaching the mask piece M to the aforementioned mask frame 11, instead of applying a strong tensile force to the mask piece itself, the side frames 22 of the mask frame 11 is elastically bent in the directions in which the end frames 23 approach each other. In this state, the mask piece is fixed to the end frame 11. By virtue of the elastic restoring force of the side frames 22, a predetermined tensile force is loaded to the mask piece.

In a case where the color cathode-ray tube of the above embodiment is constructed by using the mask frames 11 of the above structure, thermal expansion of the shadow mask 10 can be absorbed by the elastic deformation of the side frames 22 of the mask frame 11. Therefore, the color purity in the color cathode-ray tube, in which high luminance display is required, is less degraded.

Further, in a case where the shadow mask is divided into a plurality of mask pieces arranged in the horizontal direction of the phosphor screen, the tensile force required for each mask piece can be reduced. Accordingly, the tensile force which acts on each mask frame 11 is relatively small. Therefore, even if the mask frame 11 has a simple structure, the mask frame can be maintained in a satisfactory tensile force loading state, thereby reducing the manufacturing cost and the weight of the color cathode-ray tube.

Figure 9:
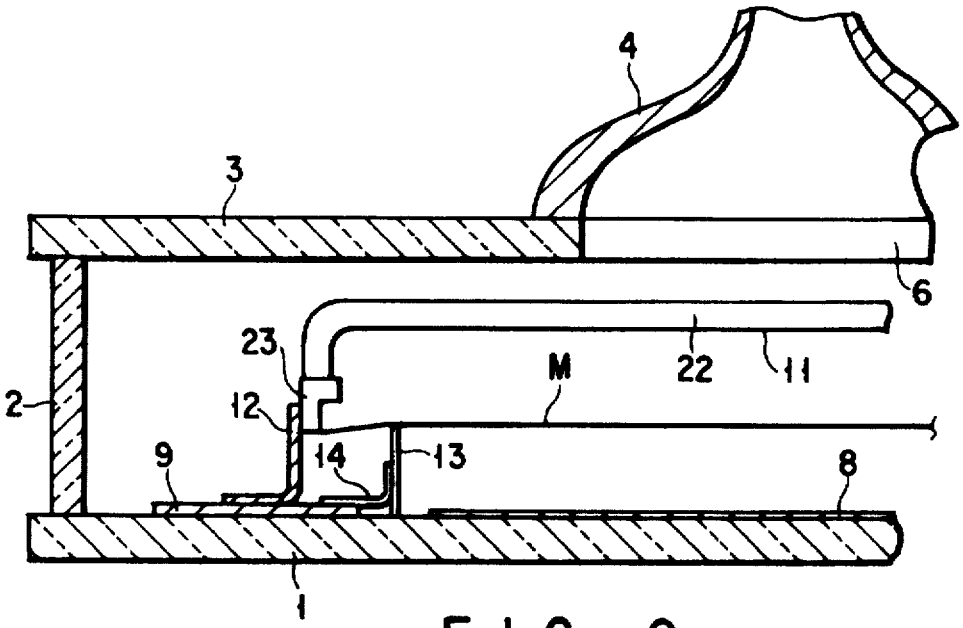
FIG. 9 is an enlarged sectional view of a mask frame mounting structure of the modification, corresponding to that shown in FIG. 6.

FIG. 9 shows a state in which the mask piece M attached to the mask frame 11 is mounted on the face plate 1. Each end frame 23 of the mask frame 11 is fixed to the corresponding fixing member 9 on the face plate 1 by the fixing piece 12. A tensile force acting on the mask piece M is increased by the stage 13 fixed to the fixing member 9, and the mask piece is positioned at a predetermined position by the stage 13.

In the above structure, the side frame 22 of the mask frame 11 can be located between the mask piece M and the rear plate 3. This structure is effective for a color cathode-ray tube in which the distance (q-value) between the shadow mask 10 and the phosphor screen 8 is narrow.

Figure 10:
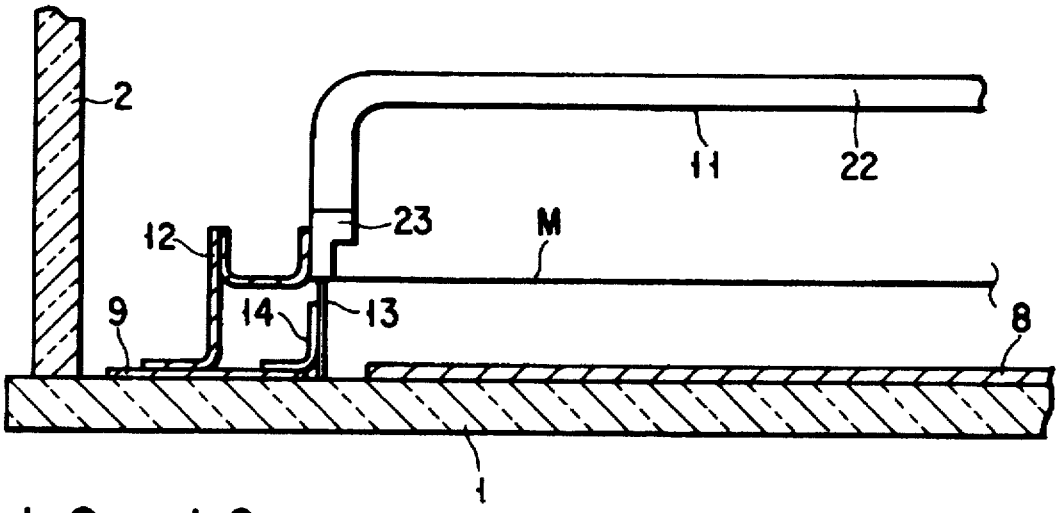
FIG. 10 is an enlarged sectional view of another mask frame mount structure of the modification, corresponding to that shown in FIG. 6.

If the mask frame 11 as shown in FIG. 8 is used, it can be attached to the face plate 1 such that the mask piece mount surfaces of the mask frame (i.e., the edges of the end frames 23) are opposed to the stages 13, as shown in FIG. 10.

The mask frame 11 of the above structure is generally assembled by welding, and the precision, particularly, the parallelism, of the mask mount surfaces of the end frame 23 is low. For this reason, the manufacturing precision of the mask mount surfaces is increased by mechanical processing, such as polishing, after welding. If the mask piece M is attached to the mask mount surfaces with the high working precision as described above, the flatness of the mask piece M need not be maintained or corrected by the stages 13.

Therefore, as shown in FIG. 10, the stage 13 can be mounted in contact with the mask mount surface of the mask frame 11 (the edges of the end frames 23), so as to be used for the purpose of only setting the distance between the shadow mask 10 and the phosphor screen 8 with high precision. The position, where the stage 13 is mounted, can be altered, so long as the above purpose is achieved. For example, if the mask frame 11 has a reference surface having the same working precision as that of the mask mount surface, the stage 13 can be arranged at a position where it is in contact with the reference surface.

Figure 11:
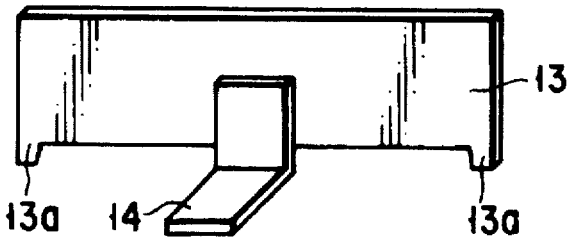
FIG. 11 is a perspective view showing a modification of the stage.
Figure 12:
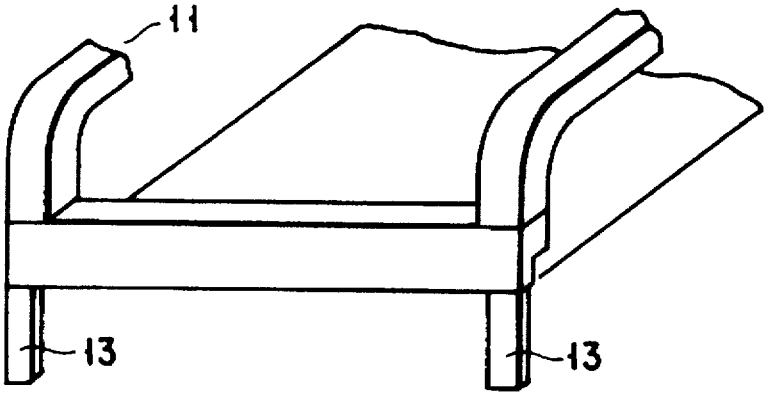
FIG. 12 is a perspective view showing another modification of the stage.

FIGS. 11 and 12 show modifications of the stage 13. According to the modification shown in FIG. 11, although the stage 13 is rectangular as in the aforementioned embodiments, it has projections 13a at both ends of the side opposed to the face plate.

With this stage 13, since only the ends of the projections 13*a* are in contact with the face plate 1, the contact area between the stage 13 and the face plate 1 is greatly reduced. It is therefore possible to prevent problems, such as rise of the stage due to dust (e.g., leaf and other trash of phosphor) entered the gap between the stage 13 and the face plate 1.

According to the modification of FIG. 12, if the mask frame 11 as shown in FIG. 8 is used, a pair of stages 13 are formed of bar members, which are directly attached to the end frames 23. With this modification also, the stage can be prevented from rising. Moreover, the stage can be attached to the end frame easily, thus improving the assembly efficiency.

The stage 13 may be formed of not only a nickel alloy or stainless steel but any other materials. For example, if the shadow mask 10 is formed of iron, it is preferable that the stage formed of iron be used. If the shadow mask 10 is formed of amber, it is preferable that the stage be formed of a nickel alloy having a coefficient of thermal expansion similar to that of amber. Further, if the magnetic characteristic is concerned, it is preferable that the stage be formed of a non-magnetic material.

FIGS. 13A to 16B shows a color cathode-ray tube according to a second embodiment of the present invention. The color cathode-ray tube of the second embodiment is also constructed such that a single phosphor screen has a plurality of regions, which are dividedly scanned by electron beams emitted from a plurality of electron guns, and divisional images obtained from the regions are integrated, thereby displaying a synthesized image on the phosphor screen. The structure of the color cathode-ray tube as a whole is the same as that of the first embodiment as described above. Therefore, the same elements as those in the first embodiment are identified with the same reference numerals, and detailed descriptions thereof will be omitted. In the following, only the portions different from the first embodiment (a phosphor screen, a shadow mask, mask frames, etc.) will be described in detail.

Figure 13A:
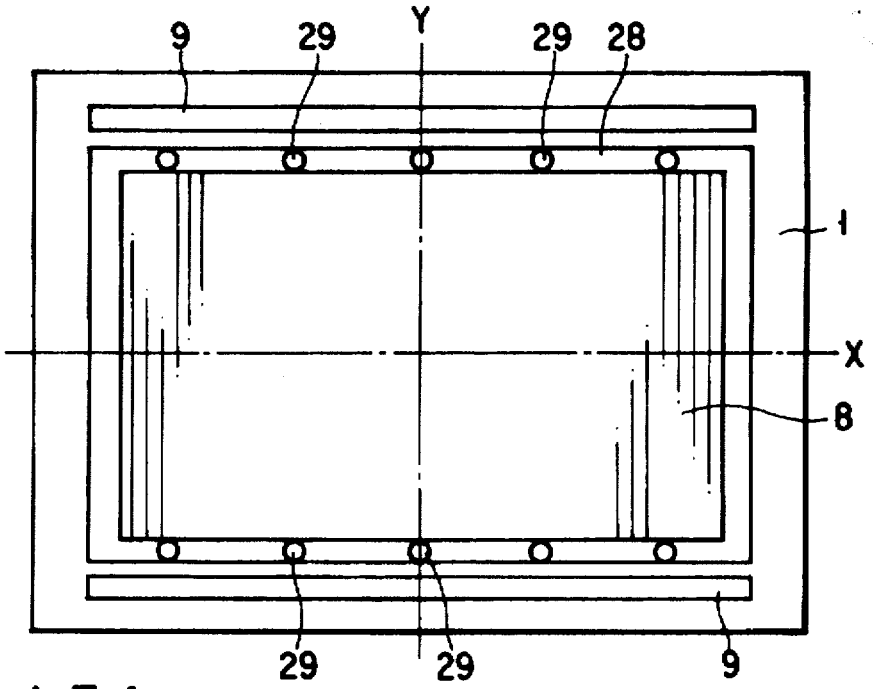
Figure 13B:
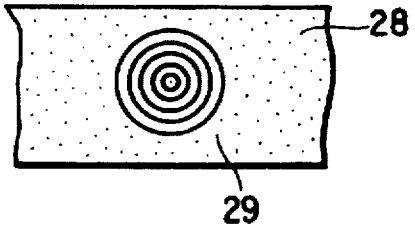
FIG. 13B is an enlarged plan view of a positioning mark.

As shown in FIGS. 13A and 13B, an integrated phosphor screen 8 is formed on the inner surface of the face plate 1. The phosphor screen 8 has stripe-shaped three-color phosphor layers 30B, 30G, 30R, extending in the vertical direction, which respectively emit blue, green and red light, and black stripe layers provided between the three-color phosphor layers and extending in the vertical direction. A non-luminous portion 28 is formed on the inner surface of the face plate 1 to surround the phosphor screen 8. The non-luminous portion 28 is formed of the same material as the black stripe layers and has a constant width.

A plurality of positioning marks 29 are formed in horizontal portions of the non-luminous portion 28, which are located on both vertical end sides of the phosphor screen 8. The positioning marks 29 are used to set the relative position between the phosphor screen 8 and the shadow mask 10. Each mark 29 is constituted by five concentric circles, each having a width of 0.05 mm. The outermost circle has a diameter of 2 mm. Five positioning marks 29 are arranged on each horizontal portion of the non-luminous portion 28 so as to correspond to the five mask pieces M1 to M5 arranged side by side in the horizontal direction.

In this color cathode-ray tube, a pair of fixing members 9, for fixing the shadow mask and the stages, are arranged adjacent to and outside the non-luminous portions 28.

In the color cathode-ray tube of this embodiment also, the shadow mask 10 is constituted by a plurality of, for example, five mask pieces, which are arranged in series at a predetermined distance in the horizontal direction. The number of mask pieces corresponds to the number of divided regions in the horizontal direction of the phosphor screen 8, which are individually scanned by electron beams emitted from a plurality of electron guns.

Figure 14:
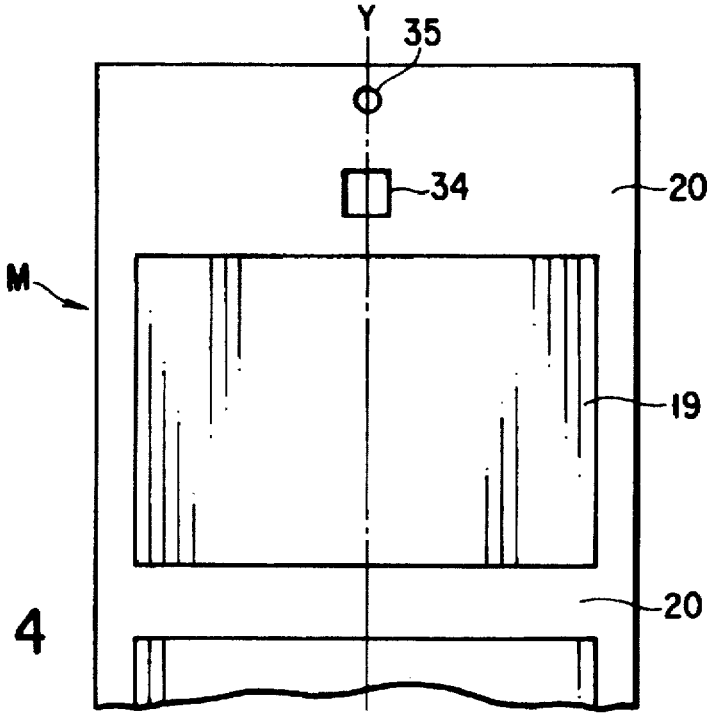

As shown in FIG. 14, the longitudinal direction of the mask piece corresponds to the vertical direction Y. Each mask piece has a plurality of effective portions 19 and non-effective portions 20 which do not have electron beam passage apertures. The effective portions are arranged in the vertical direction with the non-effective portions 20 interposed therebetween. The number of effective portions 19 corresponds to the number of divided regions in the vertical direction of the phosphor screen. The non-effective portions 20, located at both ends in the vertical direction of the mask piece, each have a positioning hole 34 corresponding to the positioning mark 29 of the face plate 1. The positioning holes 34 are adjacent to the effective portions 19 at both vertical ends of the mask piece. Outside of the positioning holes 34 in the vertical direction are formed reference holes 35 for setting a position relative to a mask frame (to be described later). The positioning hole 34 is a rectangle having sides of 2 mm, corresponding to the diameter of the outermost circle of the positioning mark 29. The reference hole 35 is a circle having a diameter of 1 mm.

Figure 15:
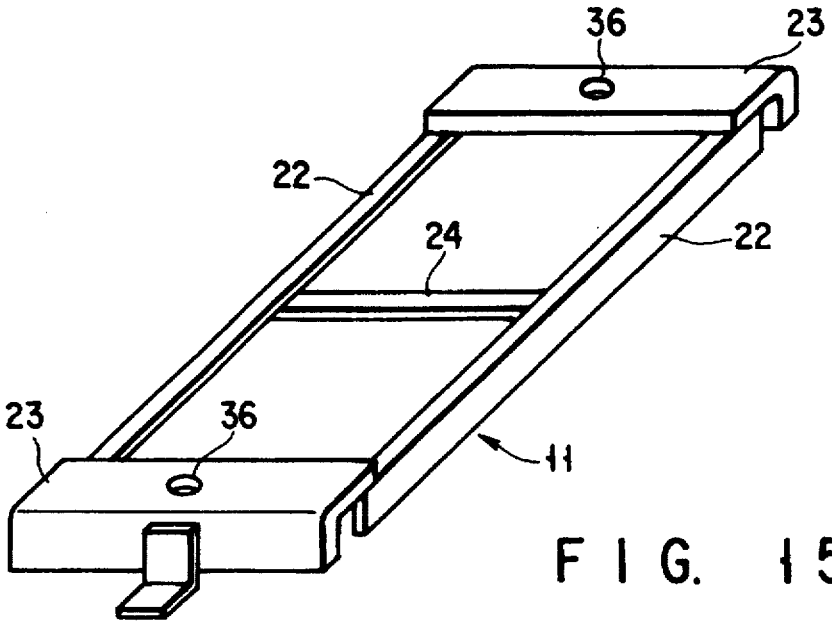

As shown in FIG. 15, similar to the first embodiment as described above, a mask frame 11 is shaped as a rectangle with a pair of side frames 22, each having an L-shaped cross section, a pair of end frames 23, each having an L-shaped cross section, arranged to cover both the ends of the side frames 22, and a reinforcing beam 24. Fixing pieces 12 are attached to the sides of the end frames 23, respectively. In the second embodiment, a reference hole 36 is formed in the end frame 23 in correspondence with the reference hole 35 of the mask piece. The reference hole 36 has the same shape and size as those of the reference hole 35.

The color cathode-ray tube, having the phosphor screen, the shadow mask and the mask frame of the aforementioned structures, is assembled as follows.

First, the fixing members 9 are fixed with frit glass to the inner surface of the face plate at both end portions in the vertical direction. The phosphor screen 8 is formed on the inner surface of the face plate, on which the fixing members 9 are fixed, by means of the master mask method in the photographic printing. The screen portion is formed in the same manner as forming a conventional black-stripe type color cathode-ray tube; that is, first, black stripes, non-luminous portions 28 around the black stripes and the positioning marks 29 in the non-luminous portions 28 at both ends in the vertical direction are formed on the phosphor screen 8 by using photosensitive material, black coating, or the like. Then, stripe-shaped three-color phosphor layers are formed between the black stripes by using photosensitive phosphor slurry. Thereafter, aluminum film is deposited on the back surface of the black stripes and the three-color phosphor layers. Thus, the screen portion is obtained.

Figure 16A:
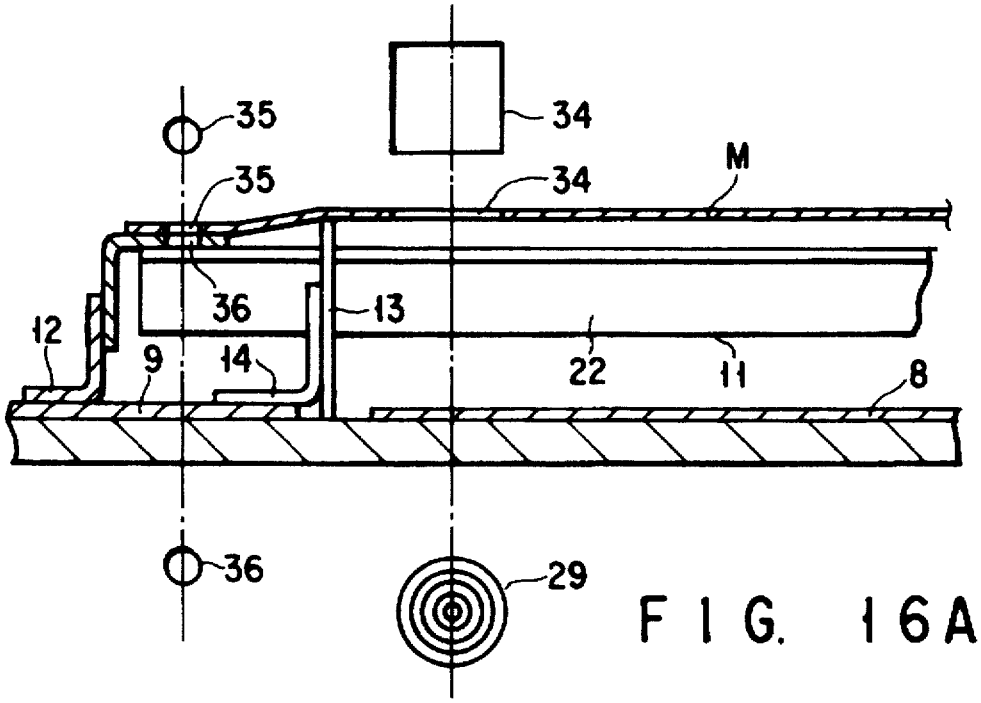
FIG. 16A is a sectional view of the mask frame and mask piece mounting structure.

Independent of the formation of the phosphor screen 8, the mask pieces are formed by the photoetching method in the same manner as forming a shadow mask of a conventional color cathode-ray tube. As shown in FIG. 16A, the mask pieces M are positioned by a mounting jig such that the reference holes 35 formed in the mask pieces M are aligned with the reference holes 36 formed in the mask frames 11. Then, the mask pieces are fixed to the end frames 23 at the ends of the mask frames 11 with a tensile force, which is smaller than the final tensile force, by means of laser spot welding at 1 mm pitches. Electron guns are respectively sealed within the necks of funnels 4.

Figure 16B:
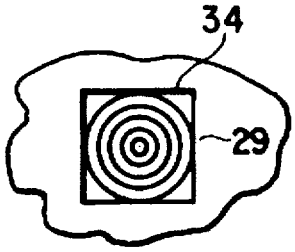

Subsequently, the stages 13 are positioned and fixed, by means of a fixing jig, to the fixing members 9 attached to the inner surface of the face plate 1 via positioning pieces 14. The face plate 1, to which the stages 13 are attached, is fixed to the fixing jig, and the mask pieces M, attached to the mask frames 11, are arranged so as to be in contact with the stages 13. Further, as shown in FIGS. 16A and 16B, the positioning mark 29 formed on the inner surface of the face plate 1 and the positioning hole 34 formed in the mask piece M are positioned with each other. In this state, the fixing piece 12 attached to the mask frame 11 is welded to the fixing member 9.

When the positioning mark 29 and the positioning hole 34 are positioned with each other, they are located apart from each other. For this reason, this positioning is performed by use of a measuring device having a double-focus optical system, by which images of different focal points can be synthesized on the same plane and observed simultaneously. In this double-focus optical system, a lens system for focusing beams on the positioning mark 29 is used as a fixed system and a lens system for focusing beams on the positioning hole 34 of the mask piece M is used as a focal-point variable system.

After the positioning mark 29 of the screen portion and the positioning hole 34 of the mask piece M are positioned with each other as described above, the mask frame 11 is gradually pressed toward the face plate 1, until the fixing pieces 12 fixed to the mask frame 11 are brought into contact with the fixing members 9, so that the tensile force of the mask piece M is increased by the stages 13 and the flatness of the mask piece M is corrected.

In this state, the focal point of the measuring device having the double-focus optical system is adjusted to the positioning mark 29 of the screen portion and the positioning hole 34 of the mask piece M, so as to observe the mark 29 and the hole 34 simultaneously. In the observation, it is confirmed whether the positioning mark 29 and the positioning hole 34 are positioned with each other, that is, whether the positioning mark 29 is aligned within the positioning hole 34 without an extruded portion. If they are not correctly positioned, the above-positioning process is executed again. When the positioning mark 29 is aligned within the positioning hole 34, the fixing pieces 12 is welded to the fixing members 9.

Thereafter, the face plate 1 to which the mask pieces M are attached, the side wall 2, the rear plate 3, and the funnels in which the electron guns are sealed, are joined together at a predetermined positional relationship and integrally connected with frit glass. The subsequent processes, such as exhaustion, are performed in the same manner as in the formation of the conventional color cathode-ray tube, thereby producing a color cathode-ray tube having the above structure.

The color cathode-ray tube can be manufactured by methods other than that as described above. For example, the funnels in which the electron guns are sealed may be connected to the rear plate in advance, and then the face plate 1, to which the mask pieces M are attached, and the rear plate, to which the side wall and the funnels are attached, are integrally connected.

Figure 17A:
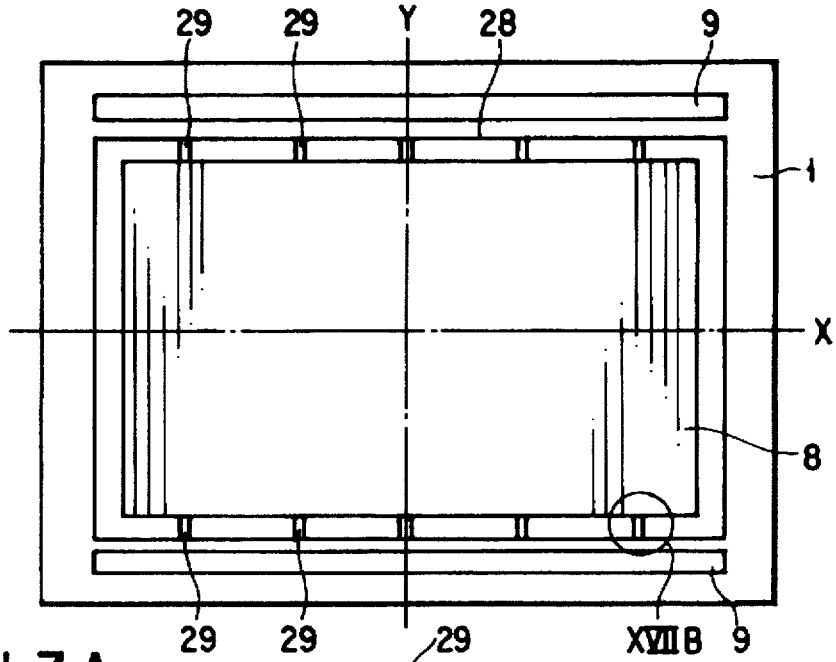
Figure 17B:
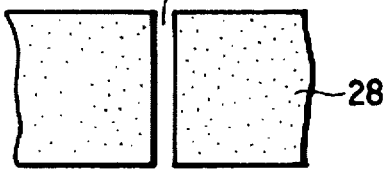
FIG. 17B is an enlarged plan view of a positioning mark.

FIGS. 17A to 19B show a third embodiment of the present invention for positioning the shadow mask with the phosphor screen 8. As shown in FIGS. 17A and 17B, according to this embodiment, positioning marks 29 on non-luminous portions 28 on the face plate 1 are formed of slits extending in the vertical direction. The width of each mark 29 is set to 200 μm.

Figure 18A:
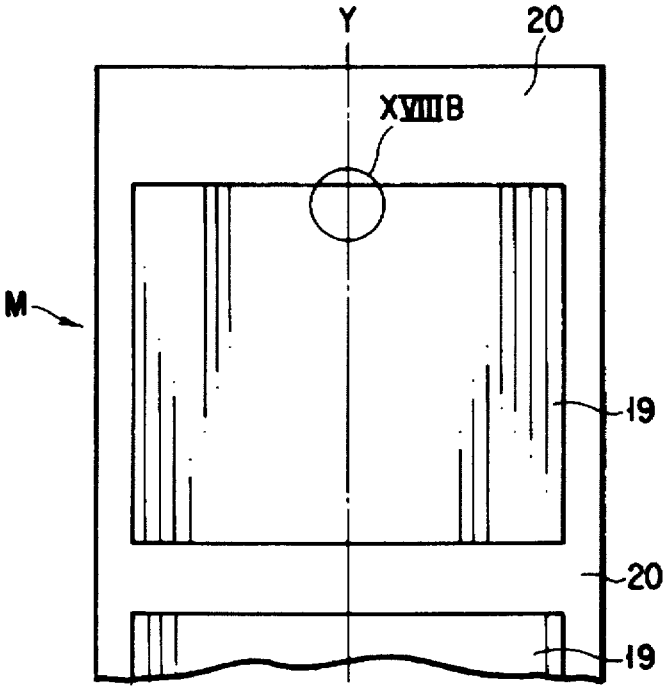
FIG. 18A is an enlarged plan view of part of a mask piece.
Figure 18B:
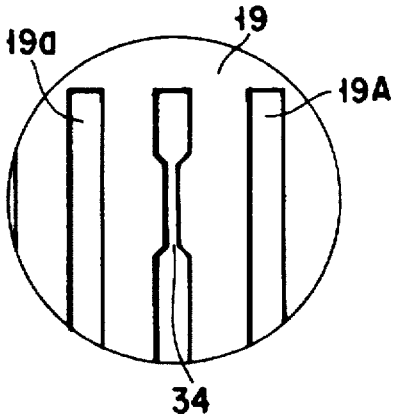
FIG. 18B is an enlarged plan view of a positioning hole.

As shown in FIGS. 18A and 18B, the effective portions 19 at the vertical end sides of the mask piece are prolonged by about 10 mm in the vertical direction toward the ends of the mask piece. In this embodiment, each effective portion 19 has a number of slits extending in the vertical direction to allow passage of electron beams. A positioning hole 34 is formed in a central portion in the horizontal direction of the prolonged portion of the effective portion 19.

The positioning hole 34 is formed of a narrow portion of a slit 19*a* at the central portion. The width of each slit 19*a* is 200 μm, while the width of the positioning hole 34 is 50 μm.

All the structure of the third embodiment, except for the aforementioned structure, is the same as the second embodiment. Therefore, the same elements as in the second embodiment are identified with the same reference numerals, and detailed descriptions thereof are omitted.

Figure 19A:
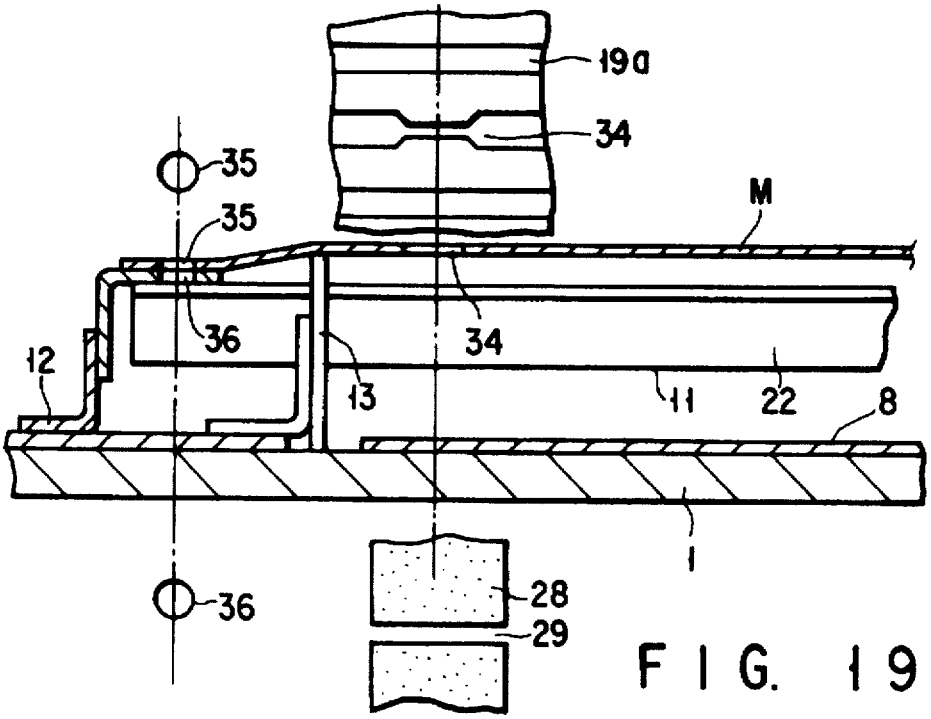
FIG. 19A is a sectional view of the mask frame and mask piece mounting structure.
Figure 19B:
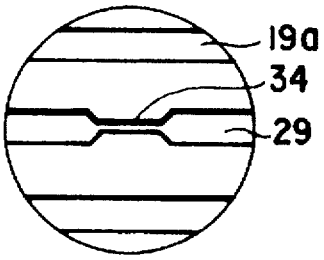

In the third embodiment, as shown in FIGS. 19A and 19B, when the mask frame 11, on which the mask piece M is attached, is fixed to the face plate 1, the positioning mark 29 and the positioning hole 34 are observed simultaneously by means of a measuring device having a double-focus optical system, so that the mask piece M can be positioned with respect to the phosphor screen 8. In this case, as shown in FIG. 19B, the mask piece M is positioned so that the positioning hole 34 completely coincides with the positioning mark 29. Thereafter, the mask frame 11 is fixed to the face plate 1 in the same manner as in the second embodiment.

The above structure is more advantageous than the second embodiment in the following respect. Since the positioning hole 34 of the mask piece M has a shape similar to that of the slit 19*a* of the effective portion 19, when a tensile force is applied to the mask piece M, imbalance of the tensile force acting on the mask piece or deformation of the mask piece is prevented, in spite of the existence of the positioning hole 34.

According to the second and third embodiments as described above, the following effects and advantages can be obtained in addition to the aforementioned effects and advantages (a) to (e) of the first embodiment.

(f) Since the positioning mark 29 is formed at the same time as forming the phosphor screen 8 on the inner surface of the face plate 1, it has the same positional relationship with respect to the three color phosphor layers constituting the phosphor screen 8. As regards the shadow mask, since the positioning hole 34 is formed at the same time as forming the effective portion 19 of the mask piece M, it has the same positional relationship with respect to the electron beam passage apertures of the effective portion 19. Thus, the phosphor screen 8 and the shadow mask can be positioned with each other at high precision by positioning the positioning mark 29 of the screen portion with the positioning hole 34 of the mask piece M.

(g) Since the positioning hole 34 is formed in the mask piece M and the positioning mark 29 can be observed through the positioning hole 34, a synthesized image of the mark and the hole can be obtained by a simple optical system and the phosphor screen 8 and the shadow mask can be easily positioned with each other.

(h) The phosphor screen 8 and the shadow mask can be positioned with each other at high precision by positioning the positioning mark 29 of the screen portion and the positioning hole 34 of the mask piece M. It is therefore unnecessary to fix the mask piece M to the mask frame 11 with very high precision. The mask piece M can be attached to the mask frame 11 by a simple means only for positioning the reference hole 36 in the mask frame 11 with the reference hole 35 in the mask piece M. Consequently, color cathode-ray tubes, having high mass-production efficiency and practicability, can be manufactured easily.

The present invention is not limited to the above mentioned embodiments but can be modified variously within the scope of the invention. For example, in the above embodiments, the positioning mark in the screen portion is constituted by concentric circles and the positioning hole of the mask piece is a rectangle. However, the positioning mark and the positioning hole may be in other shapes. It is also possible that the positioning is executed by means of cross lines instead of the concentric circles.

Further, in the above embodiments, the diameter of the outermost circle of the positioning mark is equal to the length of one side of the positioning hole. However, they can be different from each other. Furthermore, in the above embodiment, the shadow mask has effective portions which have a number of electron beam passage apertures and non-effective portions which do not have electron beam passage apertures. However, the present invention can be applied to a case in which the shadow mask has part or none of the non-effective portions.

In the above embodiments, the positioning mark in the screen portion and the positioning hole in the mask piece are observed simultaneously by a measuring device having a double-focus optical system, in order to position the phosphor screen and the shadow mask with each other. However, the positioning of the phosphor screen and the shadow mask can be achieved by any other methods. For example, the phosphor screen and the shadow mask can be positioned by, first positioning and fixing the face plate with reference to the positioning mark, then positioning the mask piece with reference to the positioning hole, and finally mechanically positioning the positioning mark and hole.

Figure 20:
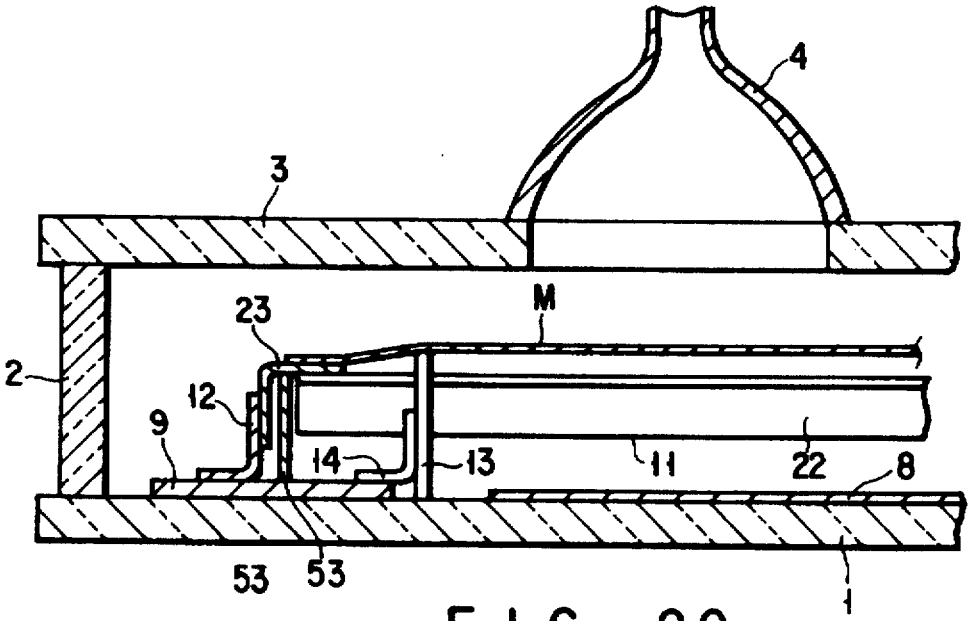
FIG. 20 is a sectional view of a modification of the mask frame mounting structure.

Further, in the above embodiment, when the color cathode-ray tube is assembled, the mask frame 11 is pressed toward the face plate by a fixing jig in a state where the mask piece is in contact with the stages. Thereafter, the mask frame 11 is fixed to the fixing members 9 on the face plate 1 via the pieces 12. For this reason, the amount of press can be set desirably, thereby adjusting the tensile force acting on the mask piece to a desired value. However, as shown in FIG. 20, it is possible that the end frame of the mask frame 11 has a plate-like restricting member 53 extending toward the face plate 1 and having a predetermined length. In this case, the amount of press of the mask frame can be restricted by the restricting member 53 and therefore can be set accurately. Moreover, since the restricting member 53 functions as a supporting member for supporting the mask frame 11, the mask frame is held stably by fixing only a central portion of the end frame 23 to the face plate 1 via the fixing member 12.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color cathode-ray tube comprising:

an envelope including a substantially rectangular face plate having first and second axes perpendicular to each other, and a rear plate opposing the face plate;

a phosphor screen formed on an inner surface of the face plate;

a shadow mask arranged in the envelope and opposing the phosphor screen, the shadow mask including a plurality of mask pieces arranged in series along the first axis, each of the mask pieces extending along the second axis and having an effective portion in which a number of electron beam passage apertures are formed;

a plurality of mask frames supporting the respective mask pieces at both ends thereof as viewed in a direction of the second axis;

a plurality of stages provided on the face plate, each defining a distance between one mask piece and the phosphor screen, each of the stages having a first end in contact with the inner surface of the face plate and a second end in contact with one of the mask frames or an end of the mask piece, as viewed in the direction of the second axis; and beam emitting means mounted on the rear plate, for emitting electron beams to the phosphor screen through the effective portions of the mask pieces so as to dividedly scan a plurality of regions of the phosphor screen.

2. A color cathode-ray tube according to claim 1, wherein the mask frames are fixed to the inner surface of the face plate.

3. The color cathode-ray tube according to claim 1, wherein each of the mask frames has a rectangular shape, and includes a pair of side frames parallel to each other and extending in the direction of the second axis, and a pair of end frames, one connecting first ends of the side frames and the other connecting second ends thereof in the direction of the second axis, each of the end frames having a mask mount portion to which an end of the mask piece is fixed.

4. A color cathode-ray tube according to claim 3, wherein:

the pair of end frames of each mask frame is fixed to the inner surface of the face plate; and the second end of each stage is in contact with an end portion in the direction of the second axis of the mask piece and extends beyond the mask mount portion of the end frame toward the rear plate so as to apply a tensile force along the second axis to the mask piece.

5. A color cathode-ray tube according to claim 4, wherein each of the mask frames comprises a restricting member, arranged between each of the end frames and the inner surface of the face plate, for defining a distance between each of the end frames and the inner surface of the face plate.

6. A color cathode-ray tube according to claim 1, wherein each of the stages has a rectangular plate-like shape having parallel side edges for forming the first and second ends.

7. A color cathode-ray tube according to claim 6, wherein each of the stages has a plurality of projections projecting from the first end and in contact with the face plate, the projections being separated from one another along the first axis.

8. A color cathode-ray tube according to claim 1, wherein each of the stages is arranged between the end frame and the face plate with the second end being in contact with the mask mount portion of the end frame; and each of the mask frames comprises a fixing member fixing the end frame to the inner surface of the face plate.

9. A color cathode-ray tube comprising:

an envelope including a substantially rectangular face plate having first and second axes perpendicular to each other, and a rear plate opposing the face plate;

a phosphor screen formed on an inner surface of the face plate;

a plurality of positioning marks formed on the inner surface of the face plate on both end sides of the phosphor screen in a direction of the second axis and arranged at predetermined positions with respect to the phosphor screen;

a shadow mask arranged in the envelope and opposing the phosphor screen, the shadow mask including a plurality of mask pieces arranged in series along the first axis, each of the mask pieces extending along the second axis and including an effective portion having a number of electron beam passage apertures, and positioning holes formed at predetermined positions on both end portions along the second axis of the mask piece, each of the mask pieces being arranged while the positioning holes being respectively aligned with the corresponding positioning marks;

a plurality of mask frames supporting the respective mask pieces at both ends thereof as viewed in a direction of the second axis;

a plurality of stages provided on the face plate, each defining a distance between one mask piece and the phosphor screen, each of the stages having a first end in contact with the inner surface of the face plate and a second end in contact with one of the mask frames or an end of the mask piece, as viewed in the direction of the second axis; and beam emitting means mounted on the rear plate, for emitting electron beams to the phosphor screen through the effective portions of the mask pieces so as to dividedly scan a plurality of regions of the phosphor screen.

10. A color cathode-ray tube according to claim 9, wherein each of the positioning marks has a circular mark having a predetermined diameter, and each of the positioning holes has a rectangular opening having a side of a length substantially equal to the predetermined diameter.

11. A color cathode-ray tube according to claim 9, wherein each of the positioning marks has a slit extending in parallel with the second axis, and each of the positioning holes is shaped as a slit extending in parallel with the second axis.

12. A color cathode-ray tube according to claim 9, wherein said plurality of mask frames support the respective mask pieces at both ends thereof in a direction of the second axis and fixed to the face plate.

13. A color cathode-ray tube according to claim 12, wherein each of the mask frames comprises a pair of side frames parallel to each other and extending in the direction of the second axis, and a pair of end frames, one connecting first ends of the side frames and the other connecting second ends thereof in the direction of the second axis, the end frames being fixed to the inner surface of the face plate, outside of the positioning marks, and each of the end frames having a mask mount portion to which an end of the mask piece is fixed.

14. A color cathode-ray tube according to claim 13, wherein each of the end frames has a first positioning hole at a predetermined position, and each of the mask pieces has second positioning holes respectively formed in both end portions in the direction of the second axis, and the mask piece is fixed to the end frames with the second positioning holes being aligned with the first positioning holes.

15. A color cathode-ray tube according to claim 12, wherein a pair of said plurality of stages is provided for each of the mask pieces, for defining a distance between each of the mask pieces and the phosphor screen, each of the stages being fixed to the face plate and having a first end in contact with the inner surface of the face plate and a second end in contact with one of the mask frame and an end in the direction of the second axis of the mask piece.

* * * * *